US009120065B2

(12) United States Patent
Santrach et al.

(10) Patent No.: US 9,120,065 B2
(45) Date of Patent: Sep. 1, 2015

(54) INTEGRATED CONTAINER AND AERATOR DEVICE

(71) Applicants: Shelley A. Santrach, Coon Rapids, MN (US); Helen C. Peterson, Coon Rapids, MN (US); Jean K. Ringold, Ramsey, MN (US); Jeff Kuberka, Ham Lake, MN (US)

(72) Inventors: Shelley A. Santrach, Coon Rapids, MN (US); Helen C. Peterson, Coon Rapids, MN (US); Jean K. Ringold, Ramsey, MN (US); Jeff Kuberka, Ham Lake, MN (US)

( * ) Notice: Subject to any disclaimer, the term of this patent is extended or adjusted under 35 U.S.C. 154(b) by 213 days.

(21) Appl. No.: 13/888,198

(22) Filed: May 6, 2013

(65) Prior Publication Data

US 2013/0300006 A1 Nov. 14, 2013

Related U.S. Application Data

(60) Provisional application No. 61/772,904, filed on Mar. 5, 2013, provisional application No. 61/645,405, filed on May 10, 2012.

(51) Int. Cl.

| | |
|---|---|
| ***B01F 3/04*** | (2006.01) |
| ***B01F 5/04*** | (2006.01) |
| ***B65D 5/74*** | (2006.01) |

(52) U.S. Cl.

CPC ..... *B01F 3/04794* (2013.01); *B01F 3/04503* (2013.01); *B01F 5/0428* (2013.01); *B65D 5/74* (2013.01); *B01F 2215/0072* (2013.01)

(58) Field of Classification Search

CPC ..... B01F 3/04; B01F 3/04099; B01F 2003/04865; B01F 2003/04872; B01F 3/04787; B01F 3/04794

USPC ..... 261/76, 77, DIG. 56, DIG. 75; 99/323.1; 426/474

See application file for complete search history.

(56) References Cited

U.S. PATENT DOCUMENTS

| | | | | |
|---|---|---|---|---|
| 5,595,104 | A | 1/1997 | Delaplaine | |
| 5,713,263 | A | 2/1998 | Burks, III | |
| 7,299,743 | B2 | 11/2007 | Moore | |
| D604,560 | S | 11/2009 | Priest | |
| 7,614,614 | B2 | 11/2009 | Sabadicci et al. | |
| D605,465 | S | 12/2009 | Benton et al. | |
| D624,355 | S | 9/2010 | Tiso | |
| D624,358 | S | 9/2010 | Maufette et al. | |
| D640,904 | S | 7/2011 | Wax | |
| D652,251 | S | 1/2012 | Goralski et al. | |
| 8,807,358 | B2 * | 8/2014 | Devoy et al. | 215/40 |
| 2007/0256568 | A1 | 11/2007 | Nudi et al. | |
| 2010/0011967 | A1 | 1/2010 | Barberio et al. | |
| 2010/0058933 | A1 | 3/2010 | Cheng | |
| 2010/0091605 | A1 | 4/2010 | Rasmussen et al. | |
| 2011/0089194 | A1 | 4/2011 | Pizzolo | |
| 2011/0154994 | A1 | 6/2011 | Sabadicci | |
| 2011/0271846 | A1 | 11/2011 | Hynes | |
| 2011/0297001 | A1 | 12/2011 | DeJohn | |
| 2012/0199013 | A1 * | 8/2012 | Gutierrez | 99/323.1 |
| 2012/0206993 | A1 * | 8/2012 | Casper et al. | 366/163.2 |

* cited by examiner

*Primary Examiner* — Robert A Hopkins

(74) *Attorney, Agent, or Firm* — George A Leone; Citadel Patent Law

(57) ABSTRACT

A box includes a top panel, a front panel and side panels. An opening is centered on a lower portion of the front panel. A tap is attached to the opening, the tap including a cylindrical body and a shut-off mechanism. An aerator body is fluidly coupled to the fluid flow opening for providing a fluid flow path through the body such that the liquid can pass downward through the aerator body.

10 Claims, 13 Drawing Sheets

INTEGRATED CONTAINER AND AERATOR DEVICE

CROSS-REFERENCE TO RELATED APPLICATIONS

This application claims priority to, and incorporates by reference, U.S. Provisional Patent Application Ser. No. 61,645,405 which was filed on May 10, 2012 and U.S. Provisional Patent Application Ser. No. 61,772,904 which was filed on Mar. 5, 2013, both applications entitled, "Integrated Container and Aerator Device."

TECHNICAL FIELD

The present invention relates to a method for liquid aerator systems and, more particularly, to a liquid aerator integrated into a liquid container such as a juice carton, wine box, bottle or the like.

BACKGROUND

It has long been known that aeration of wine and fruit juices improves flavor. Many aeration devices are commercially available, however, there are unsolved problems not addressed by known aeration devices. Typically available devices require a user to dispense the liquid from one container into another container or to install the aerator at the time a container is opened.

Currently available devices must be separately purchased, are relatively expensive, cause drips and messes and are intended to be reused. This can be inconvenient as it requires a place for storage, care in handling, cleaning and other maintenance. It is believed that no disposable device is available that is integrated with a container at manufacture to aerate wine dispensed from a box or poured from bottle.

The present invention addresses these drawbacks by providing, for the first time, a device that is integrated into the spout system of a box wine or neck of wine bottle at the time of manufacture. Each glass of wine is automatically aerated enabling the development of the wine's character as it is dispensed or poured from its container. No additional devices or user intervention required.

In an additional advance over the known art, the present invention provides an inexpensive, disposable device that can be used for the duration of the wine consumption of that specific container. It maintains the convenience of box wines as there are no additional drips or messes that a standalone aerator introduces. As a further matter of convenience, the present invention provides an aerator system that allows single package grab and go concept—i.e. grab the box wine and the aerator is included.

BRIEF SUMMARY OF THE DISCLOSURE

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one aspect, an integrated aeration system is configured to aerate a liquid. The system includes a generally parallelepiped box including a top panel, a front panel and side panels extending downwardly from said top panel. An opening is centered on a lower portion of said front panel. A tap is attached to the box opening. The tap includes a cylindrical body having a cylinder wall, an outer port and an inner end, the inner port being attached to the box opening. The tap also has a shut-off mechanism movably attached at the outer end, where the cylindrical body also includes a fluid flow opening located in the wall. An aerator body is fluidly coupled to the fluid flow opening for providing a fluid flow path through the body such that the liquid can pass downward through the aerator body. The aerator body has a fluid flow path configured to have a fluid-receiving portion configured to be open to and in fluid communication with the atmosphere to receive the liquid as the liquid is dispensed, the fluid-receiving portion defining at least a first cross-sectional area proximate the opening, and a reduced-area portion disposed downstream from and in fluid communication with the fluid-receiving portion. The reduced-area portion defines a second cross-sectional area that is smaller than the first cross-sectional area of the fluid-receiving portion and is coupled to a first air inlet extending between the fluid flow path and a side of the body, thereby fluidly coupling the atmosphere with the fluid flow path. An increased-area portion is disposed downstream of the reduced-area portion and is in fluid communication with the fluid-receiving portion, the increased-area portion defining a third cross-sectional area that is greater than the second cross-sectional area.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

Figure 1:
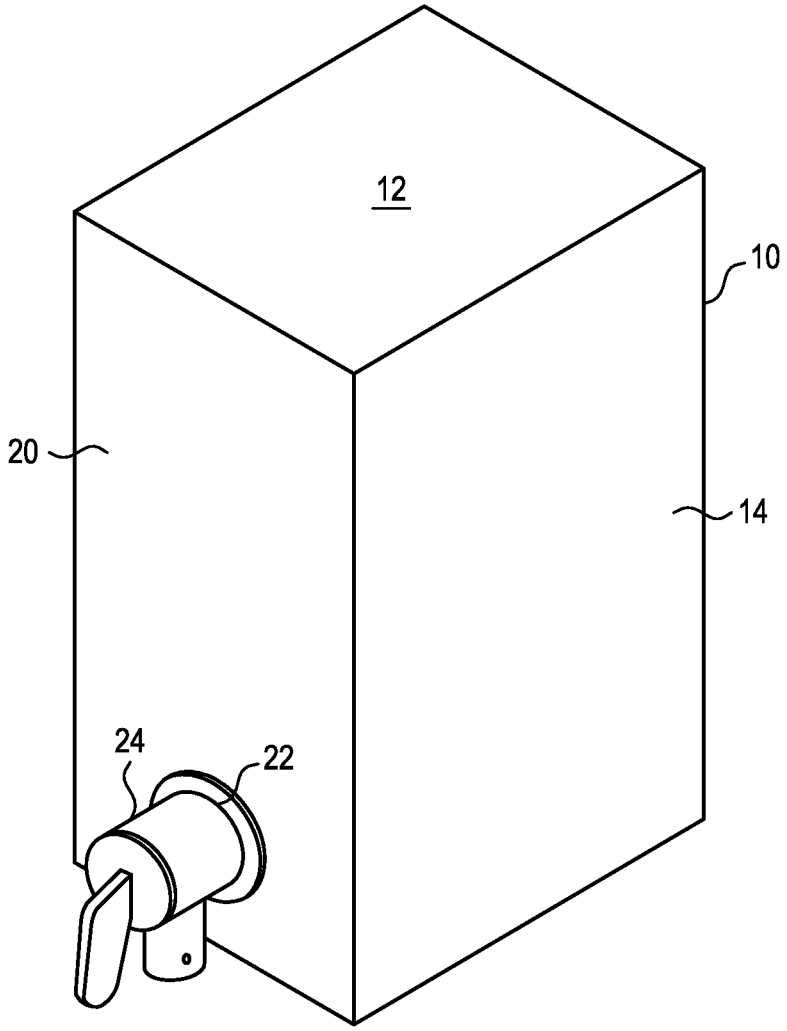
FIG. 1 schematically shows a perspective view of an example of an integrated aerator system.

In the drawings, identical reference numbers identify similar elements or components. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE PREFERRED EMBODIMENTS

The following disclosure describes several embodiments for a liquid aerator system. Several features of methods and systems in accordance with example embodiments are set forth and described in the Figures. It will be appreciated that methods and systems in accordance with other example embodiments can include additional procedures or features different than those shown in the Figures. Example embodiments are described herein with respect to a liquid aerator integrated into a liquid container such as a juice carton, wine box, bottle or the like. However, it will be understood that these examples are for the purpose of illustrating the principles, and that the invention is not so limited. Additionally, methods and systems in accordance with several example embodiments may not include all of the features shown in the Figures.

Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one example" or "an example embodiment," "one embodiment," "an embodiment" or combinations and/or variations of these terms means that a particular feature, structure or characteristic described in connection with the embodiment is included in at least one embodiment of the present disclosure. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

"Cross-sectional area" as used herein means an area taken at a cross-sectional cut of a volume or shape that is perpendicular to the path of fluid flow.

Referring now to FIG. 1, an example of an integrated aeration system configured to aerate a liquid is schematically shown. A generally parallelepiped box 10 includes a top panel 12 with, a side panel 14 on each side of said top panel 12. The box 10 further includes a front panel 20 with an opening 22 centered on a lower portion of the front panel 20. A tap 24 is attached to the box opening 22.

Figure 2:
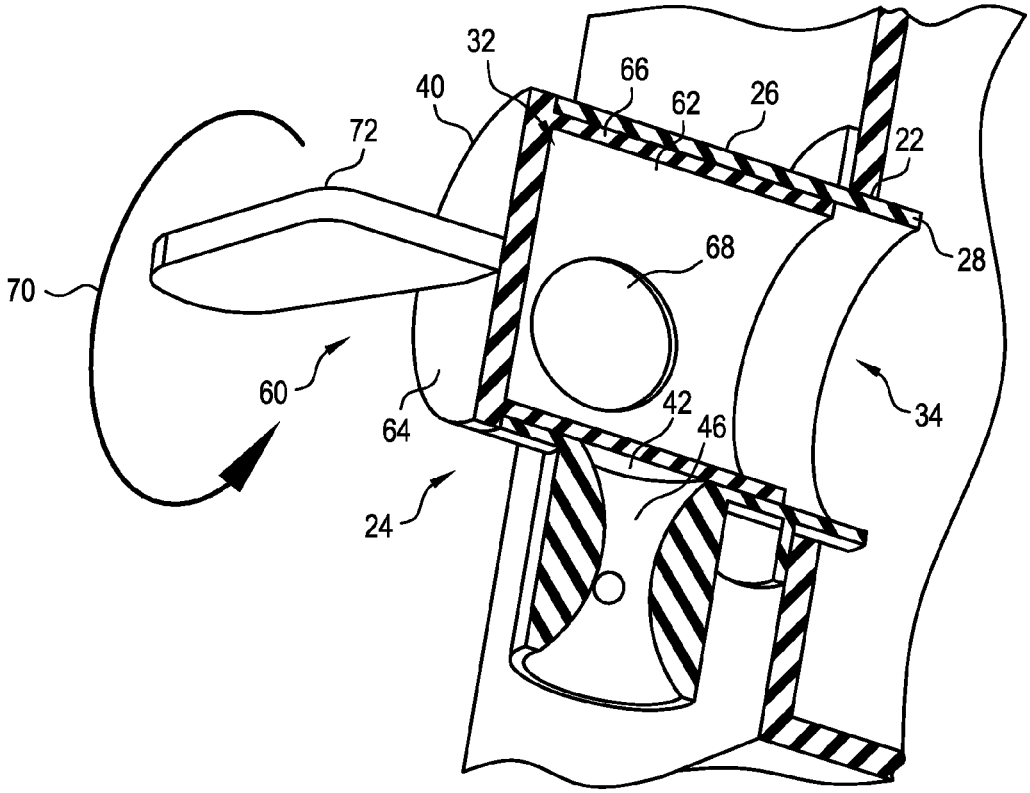
FIG. 2 shows a cross-sectional perspective view of one example of the integrated aerator system of FIG. 1.

Now referring to FIG. 2, the tap 24 includes a cylindrical body 26 having a cylinder wall 28, an outer port 32 and an inner port 34. The inner port 34 is attached to the box opening 22, the tap 24 also has a shut-off mechanism 40 movably attached at the outer port 32. The cylindrical body 26 also includes a fluid flow opening 42 located in the wall 28. An aerator body is fluidly coupled to the fluid flow opening 42, for providing a fluid flow path through the aerator body 26 such that the liquid can pass downward through the aerator body 26.

In one embodiment, the aerator body comprises a generally cylindrical outer shape. A shut-off mechanism 60 includes a generally cylindrical sleeve 62 sized to snugly fit within the aerator body, the sleeve 62 having a closed outer cover 64 and an elongated inner wall 66 including an opening 68 positioned to align with the fluid flow opening when rotated as indicated by arrow 70 so as to allow liquid to flow through the openings when aligned with each other. In one example, the shut-off mechanism 60 includes a lever 72 attached to the outer cover 64.

Figure 2A:
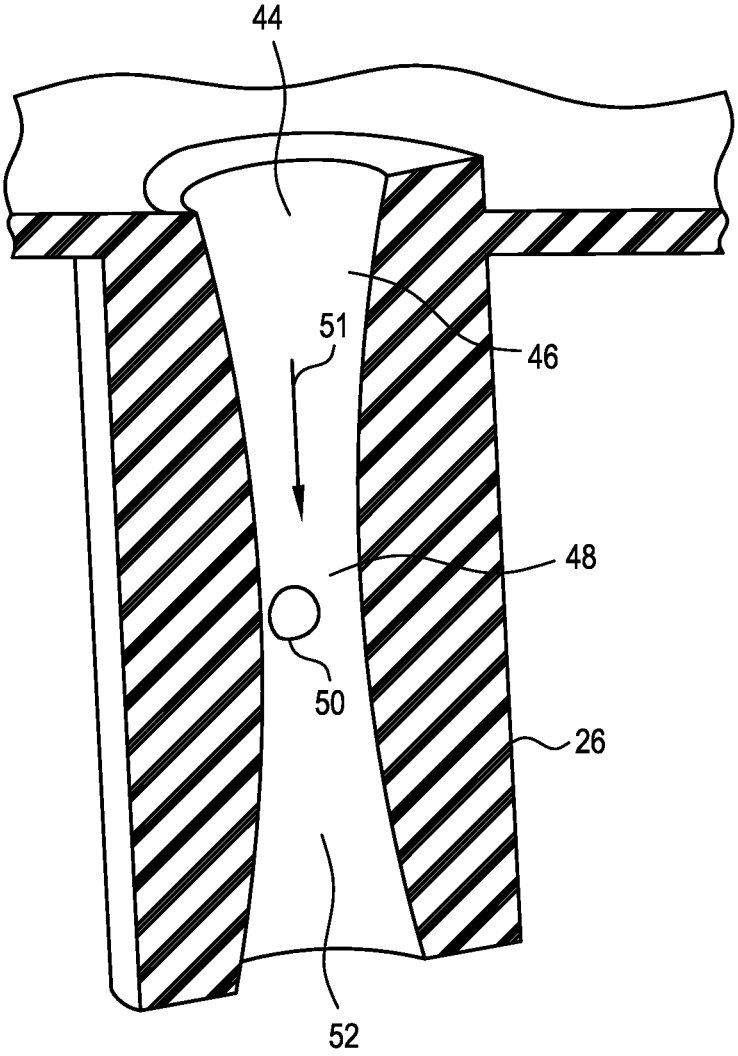
FIG. 2A shows an expanded cross-sectional view of one example of the aerator tube used in FIG. 2.

Now referring specifically to FIG. 2A, the aerator body 26 is constructed to have a fluid flow path 51 including a fluid-receiving portion 44 configured to be open to and in fluid communication with the atmosphere to receive liquid as the liquid is dispensed from the box. The fluid-receiving portion 44 is configured to have at least a first cross-sectional area 46 taken at a cross-sectional cut near the opening along a plane substantially perpendicular to the direction of fluid flow path 51. The fluid-receiving portion 44 can be generally a funnel shape such that the fluid-receiving portion provides a top aperture for entering liquid and the fluid-receiving portion is tapered such that its cross-sectional area is smaller further away from the top aperture.

A reduced-area portion is 48 is disposed downstream from and in fluid communication with the fluid-receiving portion 44, the reduced-area portion 48 defines a second cross-sectional area that is smaller than the first cross-sectional area of the fluid-receiving portion 44. A first air inlet 50 extends between the fluid flow path and a side of the body, fluidly coupling the atmosphere with the fluid flow path. An increased-area portion 52 is disposed in a vicinity of the air inlet 50. The increased-area portion 52 defines a third cross-sectional area taken proximate its outlet that is greater than the second cross-sectional area of portion 48. The increased-area portion can be part of a generally funnel-shaped volume that has a larger area of cross-section at its outlet than proximate the air inlet, when the cross-section is sliced perpendicular to the flow path.

In one useful example embodiment the increased-area portion 52 is disposed below the air inlet and is configured such that air is drawn from the atmosphere through the air inlet 50 into the fluid flow path 51 as the liquid, as for example, wine or juice, passes through the fluid flow path 51. In one example, the first and third cross-sectional areas may be at least 30%, 40%, 50%, 60%, 70% or 80% greater than the second cross-sectional area. Where the cross-sectional areas are taken along a plane substantially perpendicular to the direction of the fluid flow path. Another useful embodiment includes at least a second air inlet (as shown for example in FIG. 7) extending between the fluid flow path and a side of the body, fluidly coupling the atmosphere with the fluid flow path. The air inlets may be radially located around the aerator body running generally perpendicular to the flow path through the aerator body. For example, the second air inlet may be located on an opposite side of the fluid flow path from the first air inlet. Multiple air inlets may be disposed around the fluid flow path as desired or for specific applications.

In one embodiment a set of at least 2 pairs of air inlets may be radially disposed around the aerator body. The sets of air inlets may be coplanar and co-linear such that a line running through each of the pairs of air inlets will be substantially perpendicular to the flow path 51.

Figure 3:
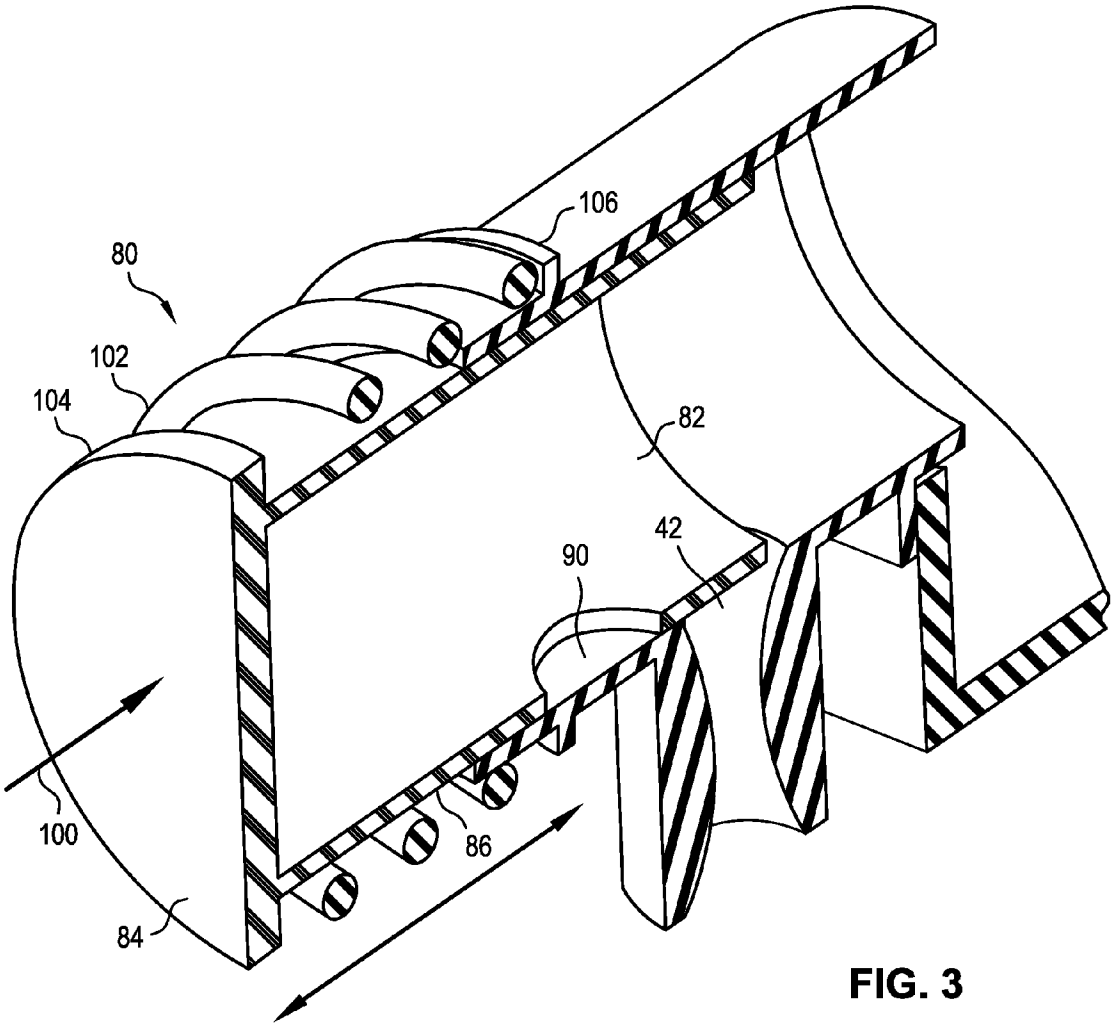
FIG. 3 schematically shows a cross-sectional perspective view of an alternate example of an integrated aerator system.

Referring now to FIG. 3, a cross-sectional perspective view of an alternate example of an integrated aerator system is schematically shown. An alternative shut-off mechanism 80 comprises a generally cylindrical sleeve 82 sized to snugly fit within the cylindrical body 26, the sleeve 82 having a closed outer cover 84 and an elongated inner wall 86 including an opening 90 positioned to align with the fluid flow opening 42 when translationally moved with an applied force 100 so as to allow liquid to flow through the openings when at least partially aligned, the shut-off mechanism 80 further includes a bias device 102 for returning the mechanism to close the tap when the applied force is removed. In one useful embodiment the bias device comprises button with a spring wound around the cylinder body and contained between a first flange 104 extending from the cover 84 and a second surface such as a second flange 106 located on the cylinder body. A (not shown) retention ring or other well-known device may be employed to hold the button in place.

Figure 4:
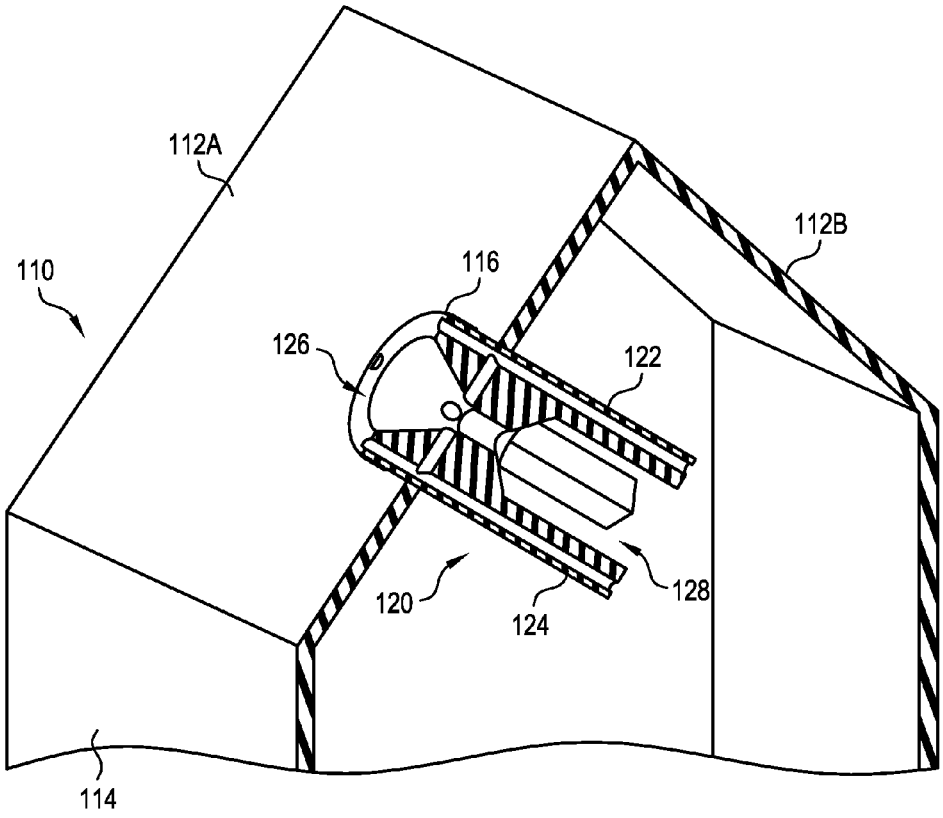
FIG. 4 schematically shows a cross-sectional perspective view of an example of an integrated box aerator system installed in a carton.

Referring now to FIG. 4, a cross-sectional perspective view of an alternate example of an integrated aerator system adapted for use in a carton is schematically shown. A generally parallelepiped carton 110 includes a set of joined top panels 112A, 112B having a triangular crossection. A plurality of side panels 114 extend from each side of said top panels 112A, 112B. A pour opening 116 is located on a portion of one of said joined top panels 112A, 112B. An aerator 120 is inserted into to the pour opening 116.

Figure 5:
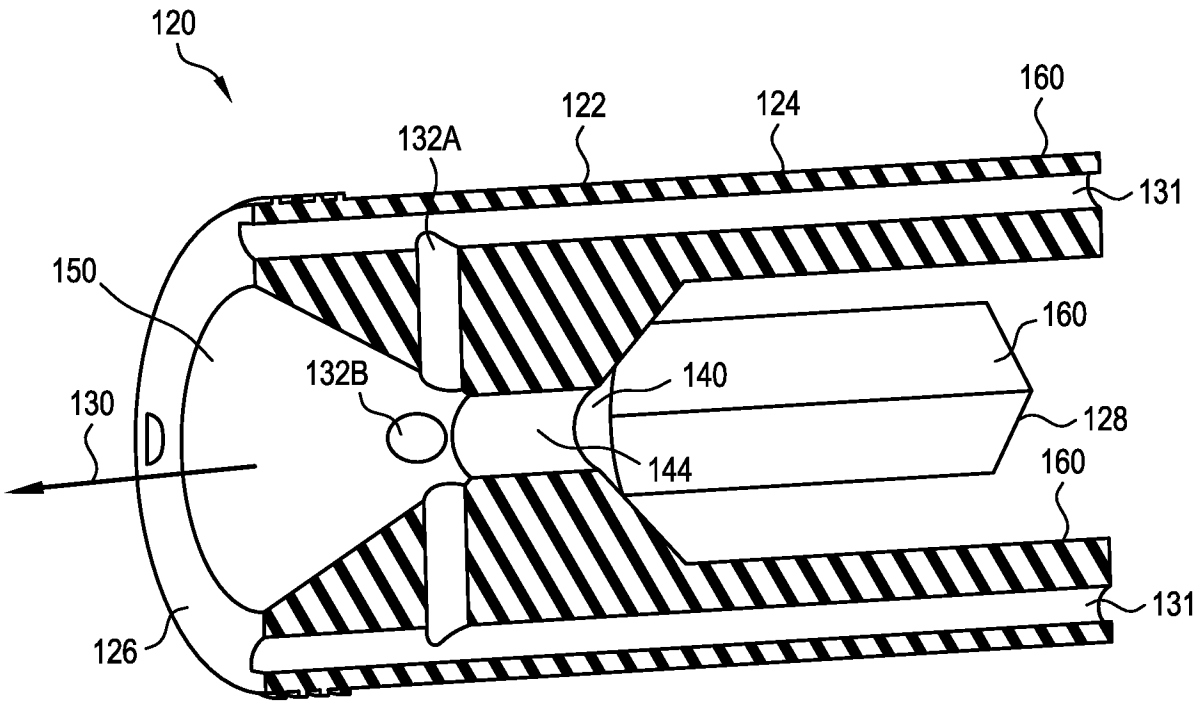
FIG. 5 schematically shows an expanded cross-sectional perspective view of an alternate example of an integrated aerator system adapted for use in a carton.

Now referring to FIG. 5, an expanded cross-sectional perspective view of an alternate example of an integrated aerator system adapted for use in a carton is schematically shown. The aerator 120 includes a body 122 having a wall 124, an outer port 126 and an inner port 128. The inner port 128 is constructed to be inserted into the carton for providing a fluid flow path through the aerator body 122 such that liquid, such as orange juice or the like, can pass downward through the aerator body 122. Similarly to the aerator described above, the aerator body 122 encompasses a fluid flow path 130 configured to have a plurality of extended gas intake channels 131 aligned in parallel relationship to the aerator body wall 124 and extending through the aerator body wall 124 into the carton 110 (as shown in FIG. 4).

A fluid-receiving portion 140 is configured to be open to and in fluid communication with the atmosphere to receive the liquid as the liquid is dispensed, the fluid-receiving portion 140 defining at least a first cross-sectional area along a plane substantially perpendicular to the direction of fluid flow path. A reduced-area portion 144 is disposed downstream from and in fluid communication with the fluid-receiving portion. The reduced-area portion 144 may be generally cylindrical defining a second cross-sectional area that is smaller than the first cross-sectional area of the fluid-receiving portion. A first air inlet 132A extends between the fluid flow path and the wall, fluidly coupling the atmosphere with the fluid flow path. A second air inlet 132B may be employed extending between the fluid flow path 130 and another section of the wall, fluidly coupling the atmosphere with the fluid flow path. A generally cone shaped increased-area portion 150 is disposed in a vicinity of the air inlet, the increased-area portion 150 defining a third cross-sectional area that is greater than the second cross-sectional area, where both cross-sectional areas are taken along planes substantially perpendicular to the direction of the fluid flow path. In one useful example, the aerator body includes a plurality of legs 160 extending beyond the aerator body, the legs also being aligned with and extending the gas intake channels 131.

Figure 6:
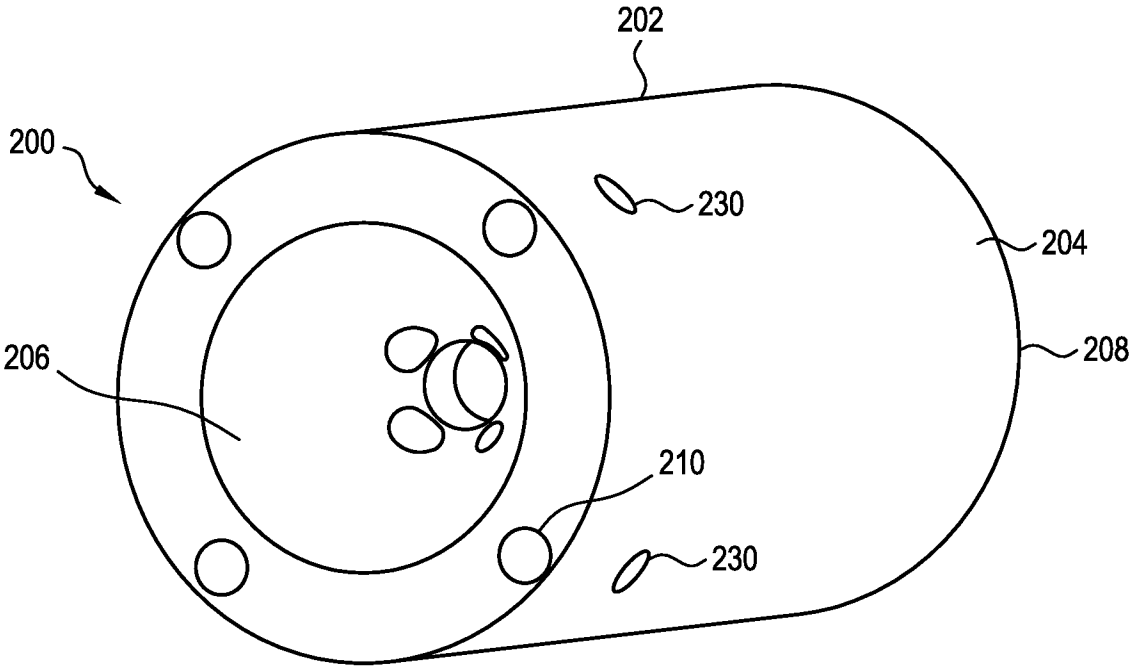
FIG. 6 schematically shows a perspective view of an alternate example of an aerator adapted for use in a bottle.

Referring now to FIG. 6, a perspective view of an alternate example of an aerator adapted for use in a bottle is schematically shown. An aeration device 200 is adapted to be inserted into a bottle to aerate a liquid dispensed from the bottle. The aerator 200 includes a generally cylindrical body 202 having a wall 204, an outer port 206 and an inner port 208, the inner port 208 being adapted to be inserted into the bottle for providing a fluid flow path through the aerator body such that the liquid can pass downward through the aerator body. At least one air inlet 230 is provided.

Figure 7:
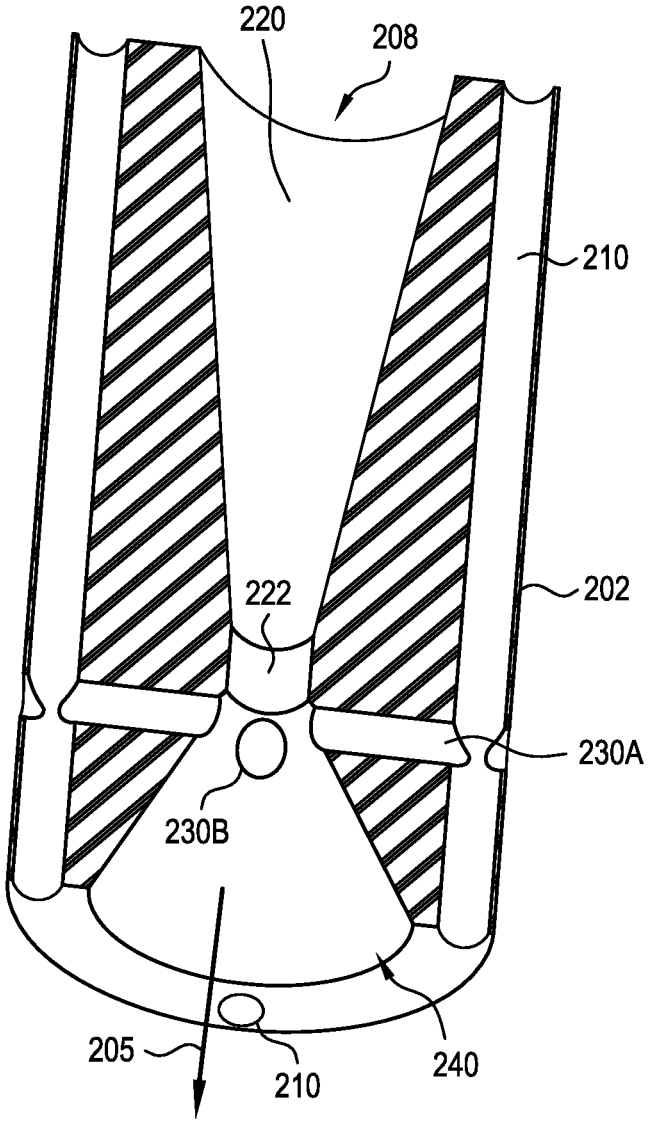
FIG. 7 schematically shows a cross-sectional perspective view of the aerator of FIG. 6.

Now referring to FIG. 7, a cross-sectional perspective view of the aerator of FIG. 6 is schematically shown. The aerator body 202 has a fluid flow path 205 and is configured to have a plurality of extended gas intake channels 210 aligned in parallel relationship to the aerator body wall 204 and extending lengthwise through the aerator body wall. A fluid-receiving portion 220 is configured to be open to and in fluid communication with the atmosphere to receive the liquid as the liquid is dispensed, the fluid-receiving portion is generally funnel shaped and has a first cross-sectional area, where the first cross-sectional area may be taken at a slice proximate the opening and perpendicular to the flow. A reduced-area portion 222 is disposed downstream from and in fluid communication with the fluid-receiving portion 220, the reduced-area portion 222 defining a second cross-sectional area that is smaller than the first cross-sectional area of the fluid-receiving portion. A first air inlet 230A extends between the fluid flow path and a section of the wall, fluidly coupling the atmosphere with the fluid flow path. An increased-area portion 240 is disposed in a vicinity of the air inlet 230A, the increased-area portion having a third cross-sectional area of a funnel that is greater than the second cross-sectional area when taken proximate the outlet as a slice made perpendicular to the flow direction. As in the other embodiments described herein above, at least a second air inlet 230B can be included to extend between the fluid flow path the wall, fluidly coupling the atmosphere with the fluid flow path.

Figure 8:
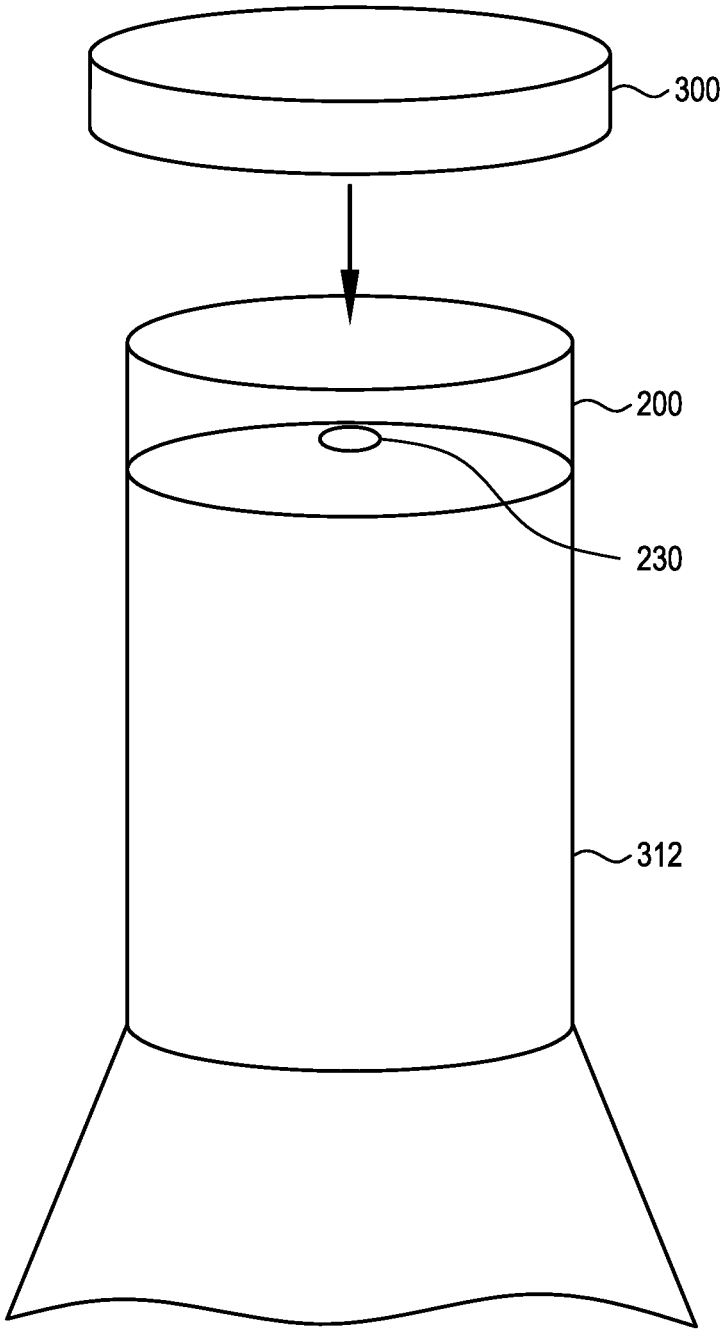
FIG. 8 schematically shows an aerator inserted into a bottle top.

Referring now to FIG. 8, an aerator inserted into a bottle top is schematically shown. A bottle-stop aerator 200 is shown inserted into bottle neck 312. A cap 300, such as a screw-on metal cap or the like, is used to cover and close over the bottle and aerator 200 such that no liquid is allowed to leak out. Air inlets 230 protrude above the bottle neck, but are covered over when capped.

Figure 9A:
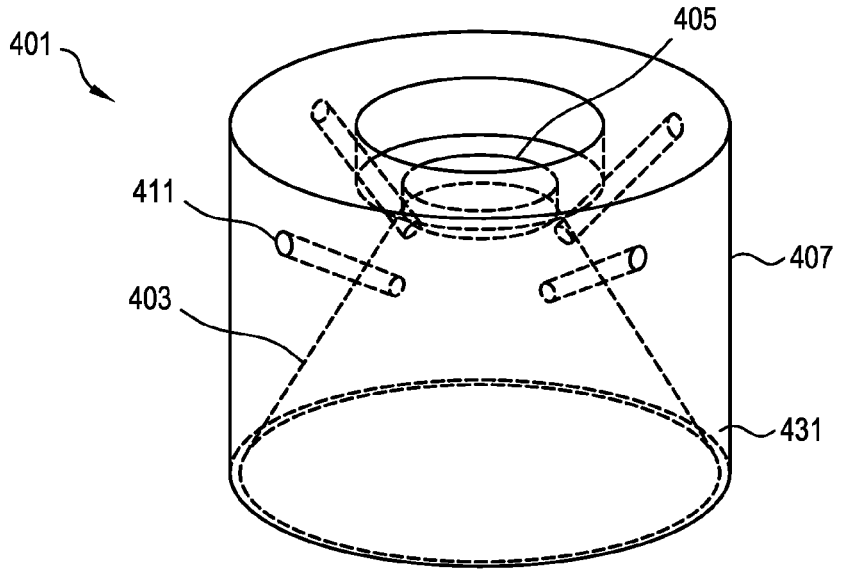
FIG. 9A-FIG. 9C schematically show another design for a bag in the box adapter for use in an integrated aerator system that press fits onto most common taps.
Figure 9B:
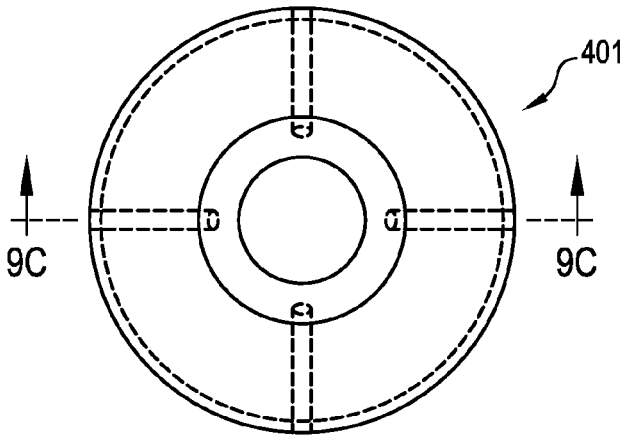
Figure 9C:
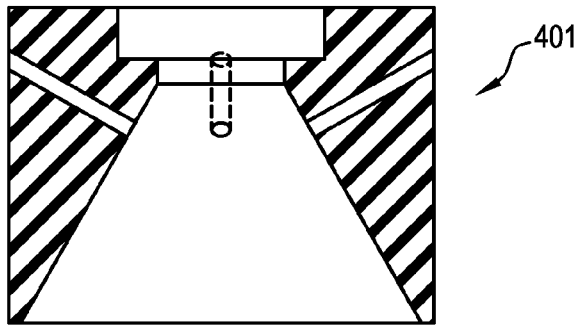

Referring now to FIG. 9A, another design for a bag in the box adapter for use in an integrated aerator system that press fits onto most common taps is schematically shown. A box adapter 401 includes a funnel portion 403 terminating in a cylindrical outlet port 405. An outer housing 407 is adapted to be press fit into a tap as described above with respect to other configurations. The funnel portion 403 is in fluid communication with outside air through a plurality of channels 411, where the plurality of channels are advantageously angled to the sidewall 431 of the outer housing. FIG. 9B illustrates a top view of the adapter 401 and FIG. 9C shows a cross-sectional view of the adaptor 401 taken along a plane passing though a center top line.

Figure 10A:
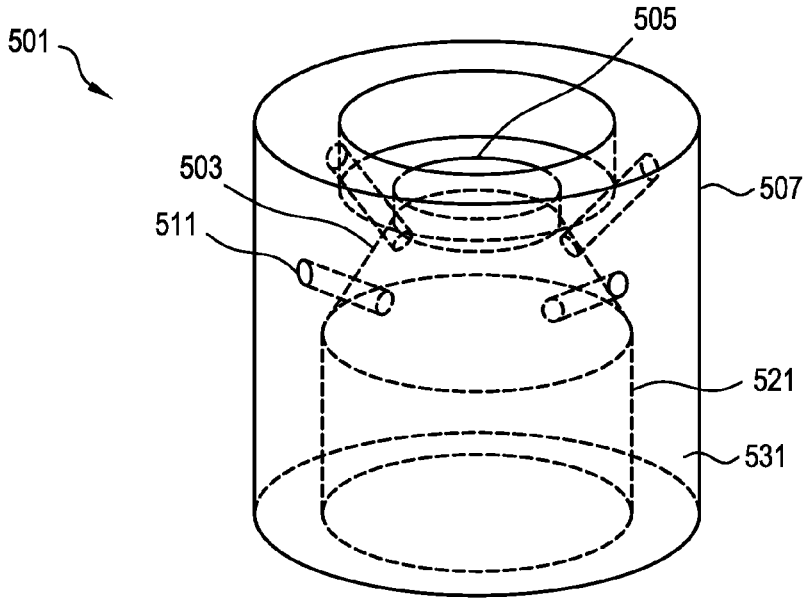
FIG. 10A-FIG. 10C schematically show yet another design for a bag in the box adapter for use in an integrated aerator system modified for flow and slightly reduced size from that of FIG. 9A-FIG. 9C that press fits onto most common taps.
Figure 10B:
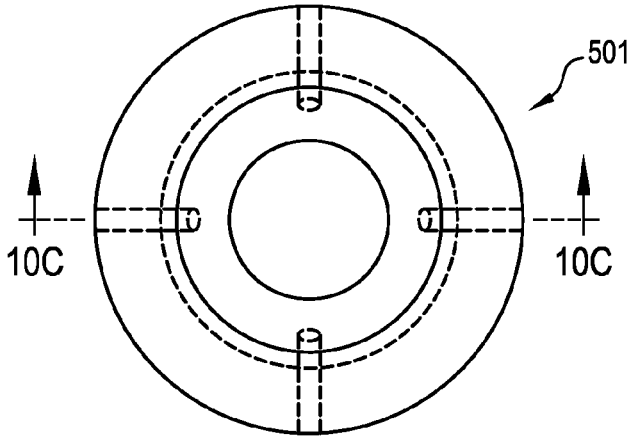
Figure 10C:
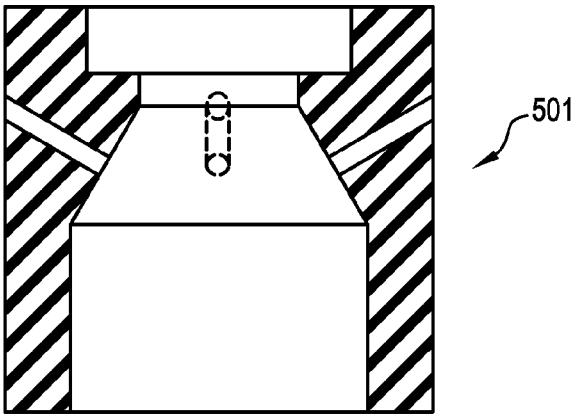

Referring now to FIG. 10A, yet another design for a bag in the box adapter for use in an integrated aerator system modified for flow and slightly reduced size from that of FIG. 9 that press fits onto most common taps is schematically shown. A box adapter 501 includes an input channel 521 joined to a funnel portion 503 terminating in a cylindrical outlet port 505. An outer housing 507 is adapted to be press fit into a tap as described above with respect to other configurations. The funnel portion 503 is in fluid communication with outside air through a plurality of channels 511, where the plurality of channels are advantageously angled to the sidewall 531 of the outer housing. FIG. 10B illustrates a top view of the adapter 501 and FIG. 100 shows a cross-sectional view of the adaptor 501 taken along a plane passing though a center top line.

Figure 11A:
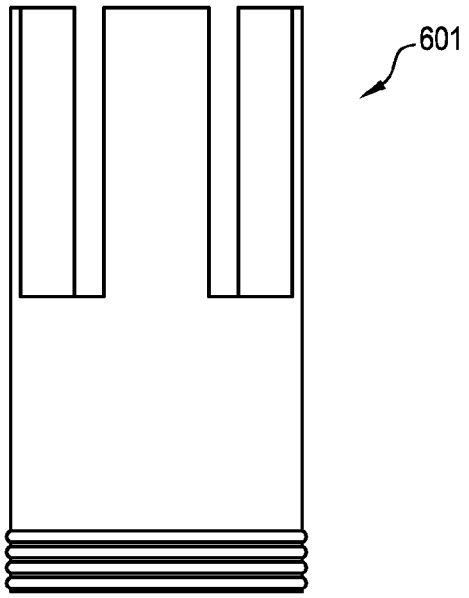
FIG. 11A-FIG. 11E schematically show various views of a carton insert implementation to be used as adapter for carton style containers.
Figure 11B:
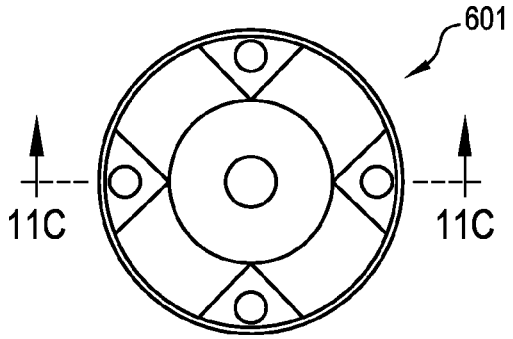
Figure 11C:
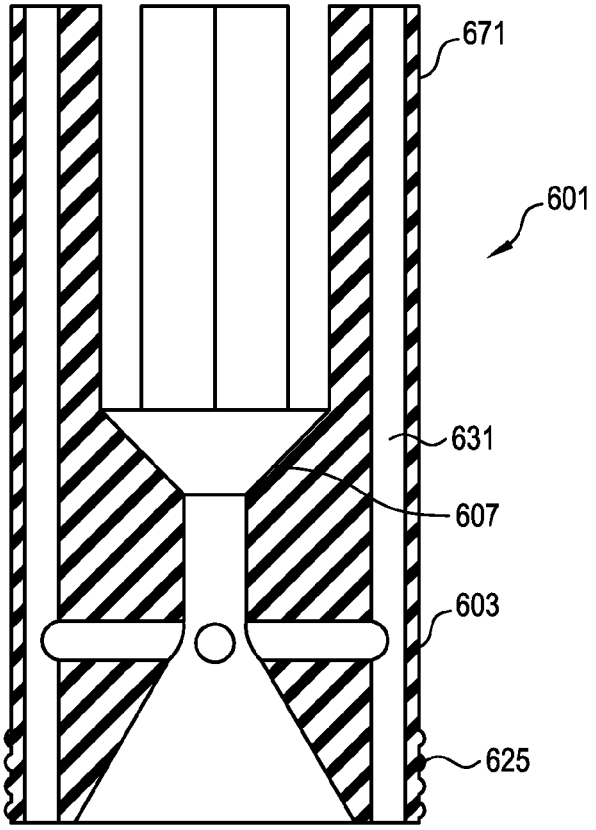
Figure 11D:
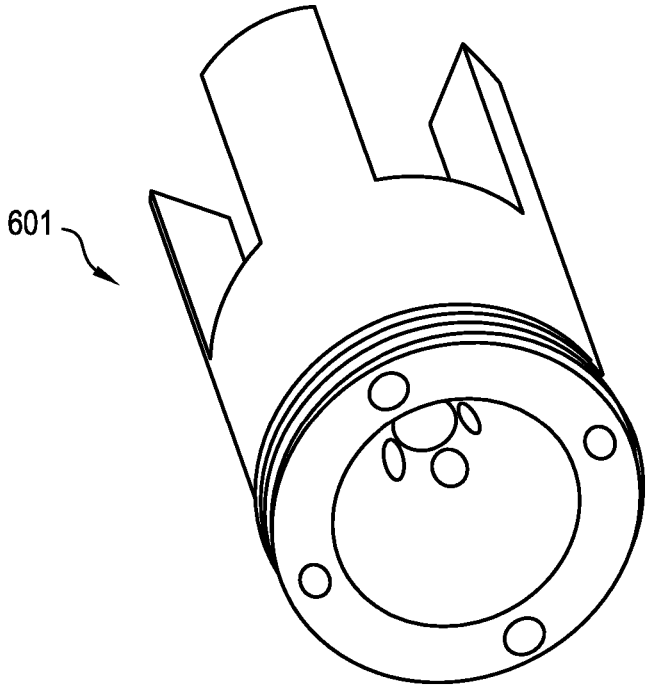
Figure 11E:
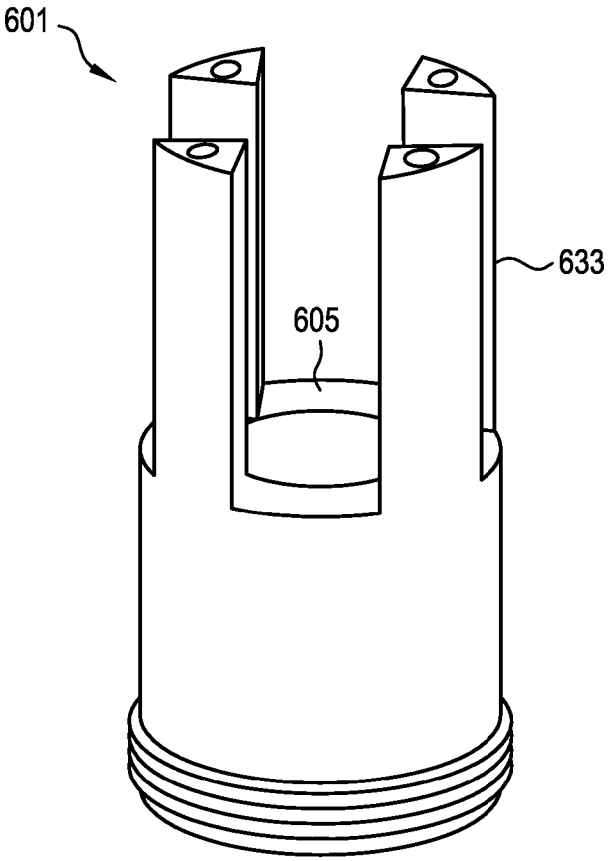

Referring now to FIG. 11A-FIG. 11E, various views of an alternate carton insert implementation to be used as adapter for carton style containers is schematically shown including from left to right a side view FIG. 11A, a top view FIG. 11B, a cross-sectional view FIG. 11C, a perspective view FIG. 11D showing the top end and a perspective view FIG. 11E showing the gas intake channel ends. A carton insert 601 is constructed substantially the same as aerator 120 described hereinabove with reference to FIG. 4 and FIG. 5. In a departure from the design of aerator 120, carton insert 601 includes a cylindrical housing 603 within which is located a funnel portion 607. Carton insert 601 encompasses a fluid flow path configured to have a plurality of extended gas intake channels 631 aligned in parallel relationship to the aerator body wall 671 and adapted to extend through the aerator body wall into a carton. The extended gas intakes are integrated with and extend beyond the cylindrical housing 603. The cylindrical housing has a bottom end 605 which generally forms a flat ring having sections partitioned by extended gas intake legs 633. A threaded end 625 is threaded to accept a standard carton screw-on cap (not shown).

In any of the examples described above the aerator bodies may be made using known manufacturing techniques. Materials may include standard synthetic wine stopper materials, plastics, polymers and the like.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by different equipment, and devices, and that various modifications, both as to the equipment details and operating procedures, may be accomplished without departing from the true spirit and scope of the present invention.

What is claimed is:

1. An integrated aeration device configured to aerate a liquid in a bottle, the device comprising:

an aerator including a body having a wall, an outer port and an inner port, the inner port being inserted into the bottle after filling for providing a fluid flow path through the aerator body such that the liquid can pass downward through the aerator body, the aerator body having a fluid flow path configured to have a plurality of extended gas intake channels aligned in parallel relationship to the aerator body wall and extending lengthwise through the aerator body wall, a fluid-receiving portion configured to be open to and in fluid communication with the atmosphere to receive the liquid as the liquid is dispensed, the fluid-receiving portion defining at least a first cross-sectional area, a reduced-area portion disposed downstream from and in fluid communication with the fluid-receiving portion, the reduced-area portion defining a second cross-sectional area that is smaller than the first cross-sectional area of the fluid-receiving portion, a first air inlet extending between the fluid flow path and a side of the body, fluidly coupling the atmosphere with the fluid flow path, where the aerator body is placed into the bottle neck so that the air inlet is exposed above the bottle neck;

an increased-area portion disposed downstream of the reduced-area portion and in fluid communication with the fluid-receiving portion, the increased-area portion defining a third cross-sectional area that is greater than the second cross-sectional area; and a cap attached to cover the top of the aerator body including the air inlet and bottle top.

2. The integrated aeration system of claim 1 further comprising a second air inlet extending between the fluid flow path and a side of the body, fluidly coupling the atmosphere with the fluid flow path.

3. The integrated aeration system of claim 1 wherein the fluid-receiving portion comprises a substantially funnel-shaped volume tapering down from the opening.

4. The integrated aeration system of claim 1 wherein the increased-area portion comprises a substantially funnel-shaped volume that has a larger cross-sectional area at a fluid outlet port.

5. An integrated aeration system configured to aerate a liquid, the system comprising:

a generally parallelepiped box including a top, a front panel and a plurality of side panels extending downwardly from said top;

a first fluid flow opening in said box;

a tap attached to the first fluid flow opening, the tap including a cylindrical body having a cylinder wall, an outer port and an inner port, the inner port being attached to the fluid flow opening, the tap also having a shut-off mechanism;

an aerator body, fluidly coupled to the outer port, for providing a second fluid flow path through the aerator body, the second fluid flow path configured to have a fluid-receiving portion configured to be open to and in fluid communication with the atmosphere, the fluid-receiving portion defining at least a first cross-sectional area, a reduced-area portion disposed downstream from and in fluid communication with the fluid-receiving portion, the reduced-area portion defining a second cross-sectional area that is smaller than the first cross-sectional area of the fluid-receiving portion, a first air inlet extending between the second fluid flow path and a side of the aerator body, fluidly coupling the atmosphere with the second fluid flow path, the aerator further including an increased-area portion disposed downstream of the reduced-area portion and in fluid communication with the fluid-receiving portion, the increased-area portion defining a third cross-sectional area that is greater than the second cross-sectional area;

wherein the shut-off mechanism comprises a generally cylindrical sleeve sized to snugly fit within the cylindrical body, the cylindrical sleeve having a closed outer cover and an elongated inner wall including a sleeve opening positioned to align with the second fluid flow opening when translationally moved with an applied force so as to allow liquid to flow through the sleeve opening and the second fluid flow opening, the shut-off mechanism further includes a button with a spring wound around the cylindrical body and contained between a first flange extending from the closed outer cover and a second flange located on the cylinder body for returning the mechanism to close the tap when the applied force is removed.

6. The integrated aeration system of claim 5 wherein the increased-area portion is configured and disposed such that air is drawn from the atmosphere through the air inlet into the second fluid flow path as the liquid passes through the fluid flow path.

7. The integrated aeration system of claim 5 wherein the third cross-sectional area is at most 80% greater than the second cross-sectional area.

8. The integrated aeration system of claim 5 further comprising a second air inlet extending between the fluid flow path and a side of the aerator body, fluidly coupling the atmosphere with the second fluid flow path.

9. The integrated aeration system of claim 5 wherein the fluid-receiving portion provides a top aperture for entering liquid and the fluid-receiving portion is tapered such that its cross-sectional area is smaller further away from the top aperture.

10. The integrated aeration system of claim 5 wherein the aerator body comprises a generally cylindrical outer shape.

* * * * *